US008314741B2

(12) United States Patent
Nagai et al.

(10) Patent No.: US 8,314,741 B2
(45) Date of Patent: Nov. 20, 2012

(54) ONE-WAVELENGTH LOOP ANTENNA

(75) Inventors: Takuya Nagai, Aichi (JP); Tomohiro Sawazaki, Aichi (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 474 days.

(21) Appl. No.: 12/721,976

(22) Filed: Mar. 11, 2010

(65) Prior Publication Data

US 2010/0245193 A1 Sep. 30, 2010

(30) Foreign Application Priority Data

Mar. 30, 2009 (JP) ..... 2009-083079

(51) Int. Cl.
*H01Q 9/26* (2006.01)

(52) U.S. Cl. ..... 343/743; 343/726; 343/905

(58) Field of Classification Search ..... 343/741–743, 343/702, 726, 821, 803–804, 806, 850, 860, 343/905

See application file for complete search history.

(56) References Cited

U.S. PATENT DOCUMENTS

| | | | | |
|---|---|---|---|---|
| 3,550,137 | A | 12/1970 | Kuecken | |
| 5,485,165 | A * | 1/1996 | Foard | 343/741 |
| 7,969,372 | B2 * | 6/2011 | Miyashita et al. | 343/742 |
| 7,978,141 | B2 * | 7/2011 | Chi et al. | 343/741 |
| 2008/0136720 | A1 | 6/2008 | Parsche et al. | |
| 2010/0245194 | A1 * | 9/2010 | Sawazaki et al. | 343/743 |

FOREIGN PATENT DOCUMENTS

| | | |
|---|---|---|
| EP | 0 352 824 | 1/1990 |
| JP | 2001-36330 | 2/2001 |

* cited by examiner

*Primary Examiner* — Vibol Tan
(74) *Attorney, Agent, or Firm* — McCarter & English, LLP

(57) ABSTRACT

A one-wavelength loop antenna includes a looped antenna element having a length equivalent to one wavelength related to communication; and a feeding cable for feeding current to a feeding point on the antenna element, wherein an inner conductor is disposed inside an outer conductor in a section between the feeding point and an extraction position of the feeding cable distanced from the feeding point by ⅛ wavelength or more, at least one of the outer and inner conductors functioning as the feeding cable.

8 Claims, 7 Drawing Sheets

ONE-WAVELENGTH LOOP ANTENNA

CROSS REFERENCE TO RELATED APPLICATION

The present application claims priority from Japanese Patent Application No. 2009-083079, which was filed on Mar. 30, 2009, the disclosure of which is incorporated herein by reference in its entirety.

BACKGROUND OF THE INVENTION

1. Field of the Invention

The present invention relates generally to a looped one-wavelength loop antenna having a length equivalent to one wavelength related to communication, and, more particularly, to an improvement in a one-wavelength loop antenna for inhibiting the influence of a feeding cable on communication.

2. Description of the Related Art

A one-wavelength loop antenna is known, which includes a looped antenna element having a length equivalent to one wavelength related to communication and a feeding cable for feeding current to a feeding point on the antenna element. Such a one-wavelength loop antenna is in popular use. A technique for inhibiting the influence of the feeding cable on communication in such a one-wavelength loop antenna is proposed. For example, a balun-incorporated loop antenna is provided by applying such a technique. According to the technique, a loop conductor formed on a board has a balance/unbalance transformer formed on the same board to be located at one front end of the conductor at a feeding point and the balance/unbalance transformer cancels out current leaking out from the outer conductor of a coaxial cable serving as a feeding cable to inhibit the influence of current on communication.

According to control by the conventional technique, however, radiation of current from the feeding cable cannot be sufficiently canceled out, so that the influence on communication is not sufficiently inhibited. For this reason, development of a one-wavelength loop antenna that inhibits the influence of the feeding cable on communication has been in demand.

SUMMARY OF THE INVENTION

The present invention was conceived in view of the circumstances, and it is therefore an object of the present invention to provide a one-wavelength loop antenna that inhibits the influence of a feeding cable on communication.

The object indicated above is achieved in the first mode of the present invention, which provides a one-wavelength loop antenna including: a looped antenna element having a length equivalent to one wavelength related to communication; and a feeding cable for feeding current to a feeding point on the antenna element, wherein an inner conductor is disposed inside an outer conductor in a section between the feeding point and an extraction position of the feeding cable distanced from the feeding point by ⅛ wavelength or more, at least one of the outer and inner conductors functioning as the feeding cable.

The object indicated above is achieved in the second mode of the present invention, which provides the one-wavelength loop antenna, wherein at least a part of the antenna element includes a pipelike conductor having a hollow axis, and wherein the feeding cable extends through the hollow of the pipelike conductor in a section between the feeding point and an extraction position distanced from the feeding point by ⅛ wavelength or more.

The object indicated above is achieved in the third mode of the present invention, which provides the one-wavelength loop antenna, wherein the feeding cable includes a coaxial cable having an inner conductor and an outer conductor that are arranged coaxially, and wherein the antenna element includes a section including the outer conductor of the feeding cable that is between the feeding point and an extraction position distanced from the feeding point by ⅛ wavelength or more.

The object indicated above is achieved in the fourth mode of the present invention, which provides the one-wavelength loop antenna, further including a looped reflector disposed at a prescribed position relative to the antenna element, wherein at least a part of the reflector includes a pipelike conductor having a hollow axis, and wherein the feeding cable extends through the hollow of the pipelike conductor in a section between the feeding point and an extraction position distanced from the feeding point by ⅛ wavelength or more.

According to the first mode of the invention, an inner conductor is disposed inside an outer conductor in a section between the feeding point and an extraction position of the feeding cable distanced from the feeding point by ⅛ wavelength or more, at least one of the outer and inner conductors functioning as the feeding cable. Consequently, the extraction position of the feeding cable is distanced away up to a position at which the amount of current flowing through the antenna is small to preferably avoid a gain decrease due to the influence of the feeding cable. The extraction position of the feeding cable is determined to be a place distanced from the feeding point by ⅛ wavelength, at which place the amount of current is smaller than the amount of current at the feeding point. This further reduces the influence of the feeding cable. Hence the one-wavelength loop antenna that inhibits the influence of the feeding cable on communication is provided.

According to the second mode of the invention, the feeding cable extends through the hollow of the pipelike conductor in a section between the feeding point and an extraction position distanced from the feeding point by ⅛ wavelength or more. Consequently, the extraction position of the feeding cable is distanced away up to a position at which the amount of current flowing through the antenna is small to preferably avoid a gain decrease due to the influence of the feeding cable. The extraction position of the feeding cable is determined to be a place distanced from the feeding point by ⅛ wavelength, at which place the amount of current is smaller than the amount of current at the feeding point. This further reduces the influence of the feeding cable. Hence the one-wavelength loop antenna that inhibits the influence of the feeding cable on communication is provided.

According to the third mode of the invention, the antenna element includes a section including the outer conductor of the feeding cable that is between the feeding point and an extraction position distanced from the feeding point by ⅛ wavelength or more. Consequently, the extraction position of the feeding cable is distanced away up to a position at which the amount of current flowing through the antenna is small to preferably avoid a gain decrease due to the influence of the feeding cable. The extraction position of the feeding cable is determined to be a place distanced from the feeding point by ⅛ wavelength, at which place the amount of current is smaller than the amount of current at the feeding point. This further reduces the influence of the feeding cable. The outer conductor of the feeding cable is caused to operate as a part of the antenna element to achieve the configuration with fewer components. Hence the one-wavelength loop antenna that inhibits the influence of the feeding cable on communication is provided.

According to the fourth mode of the invention, the feeding cable extends through the hollow of the pipelike conductor in a section between the feeding point and an extraction position distanced from the feeding point by ⅛ wavelength or more. Consequently, in the one-wavelength loop antenna including the looped reflector, the extraction position of the feeding cable is distanced away up to a position at which the amount of current flowing through the antenna is small to preferably avoid a gain decrease due to the influence of the feeding cable. The extraction position of the feeding cable is determined to be a position distanced from the feeding point by ⅛ wavelength or more, at which position the amount of current is smaller than the amount of current at the feeding point. This further reduces the influence of the feeding cable. Hence the one-wavelength loop antenna that inhibits the influence of the feeding cable on communication is provided.

In the first to fourth modes of the invention, preferably, the one-wavelength loop antenna, including: a first feeding cable for feeding current to a first feeding point on the antenna element; and a second feeding cable for feeding current to a second feeding point, the first and second feeding cables being extracted from the common extraction position. Consequently, this allows a double-feeding one-wavelength loop antenna in which unfeeding one of the feeding cables is apt to have an influence on communication to preferably inhibit the influence of the feeding cable on communication.

In the third mode of the invention, preferably, the one-wavelength loop antenna, including: a first feeding cable for feeding current to a first feeding point on the antenna element; and a second feeding cable for feeding current to a second feeding point, the first and second feeding cables having their outer conductors electrically connected to each other at the common extraction position. Consequently, this allows a double-feeding one-wavelength loop antenna in which unfeeding one of the feeding cables is apt to have an influence on communication to preferably inhibit the influence of a feeding cable on communication.

In the first to fourth modes of the invention, preferably, the one-wavelength loop antenna, wherein the first feeding point and the second feeding point are located to be distanced from each other by ¼ wavelength. In this configuration, therefore, the second feeding point is located at the position at which a current flow becomes the minimum when current is fed to the first feeding point, while the first feeding point is located at the position at which a current flow becomes the minimum when current is fed to the second feeding point.

Preferably, the extraction position is in the middle between the first feeding point and the second feeding point on the antenna element. This enables providing a double-feeding one-wavelength loop antenna of a practical form that preferably inhibits the influence of a feeding cable on communication.

DETAILED DESCRIPTION OF THE PREFERRED EMBODIMENTS

Exemplary preferred embodiments of the present invention will now be described in detail with reference to the accompanying drawings.

Figure 1:
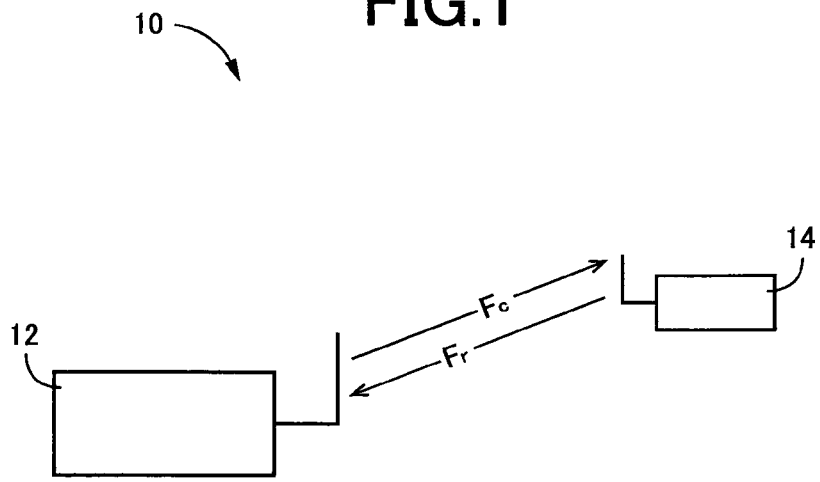
FIG. 1 is an explanatory diagram of a radio tag communication system to which the present invention applies preferably.

A radio tag communication system 10 of FIG. 1 includes a radio tag communication apparatus 12 having a one-wavelength loop antenna 36 provided as one embodiment of the present invention, and a single or a plurality (single in FIG. 1) of radio tags 14 with which the radio tag communication apparatus 12 communicates. The radio tag communication system 10 operates as so-called radio frequency identification (hereinafter "RFID") system in which the radio tag communication apparatus 12 functions as an inquirer and the radio tag 14 functions as a responder. When the radio tag communication apparatus 12 transmits an inquiry wave Fc (transmission signal) to the radio tag 14, the radio tag 14 receiving the inquiry wave Fc modulates the inquiry wave Fc with a given information signal (data) and transmits the modulated inquiry wave Fc as a response wave Fr (reply signal) back to the radio tag communication apparatus 12. In this manner, communication between the radio tag communication apparatus 12 and the radio tag 14 is carried out for information exchange. The radio tag communication system 10, for example, is used for article management, etc., in a prescribed communication area, and the radio tag 14 is, preferably, pasted on an article to be managed, thus attached integrally to the article.

Figure 2:
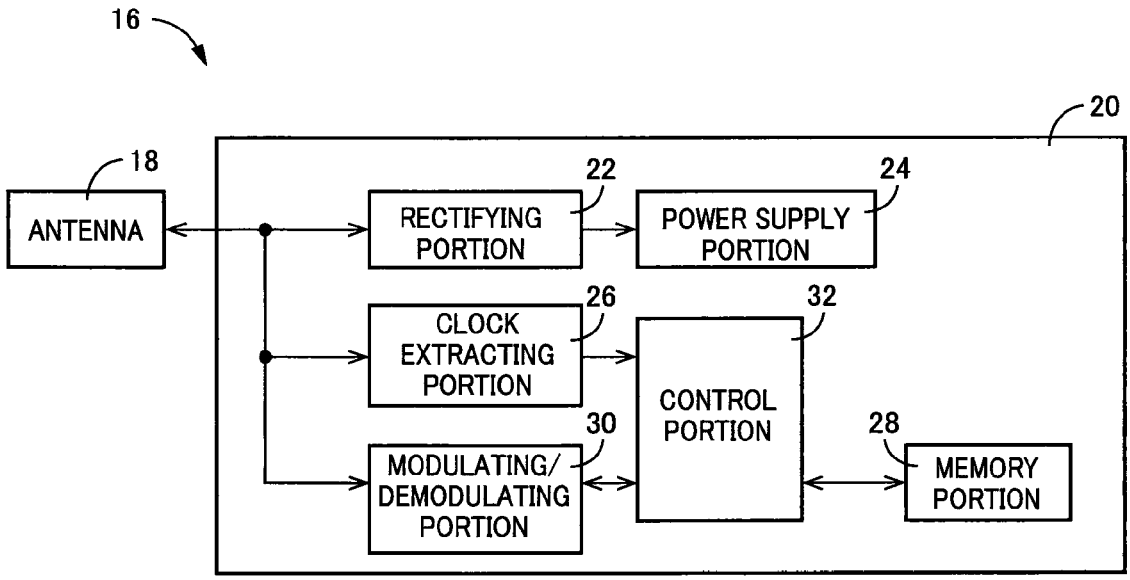
FIG. 2 is an explanatory diagram of a configuration of a radio tag circuit element incorporated in a radio tag in the radio tag communication system of FIG. 1.

As depicted in FIG. 2, a radio tag circuit element 16 includes an antenna portion 18 that transmits/receives a signal to/from the radio tag communication apparatus 12 and an IC circuit portion 20 that is connected to the antenna portion 18 to carry out information communication with the radio tag communication apparatus 12. The IC circuit portion 20 functionally includes a rectifying portion 22 that rectifies the inquiry wave Fc from the radio tag communication apparatus 12 that is received by the antenna portion 18, a power supply portion 24 that accumulates the energy of the inquiry wave Fc rectified by the rectifying portion 22, a clock extracting portion 26 that extracts a clock signal from a carrier wave received by the antenna portion 18 to supply the clock signal to a control portion 32, a memory portion 28 functioning as an information storage portion capable of storing a given information signal, a modulating/demodulating portion 30 that is connected to the antenna portion 18 to modulate/demodulate a signal, and the control portion 32 that controls operation of the radio tag circuit element 16 via the rectifying portion 22, the clock extracting portion 26, the modulating/demodulating portion 30, etc. The control portion 32 executes basic control, such as control for communicating with the radio tag communication apparatus 12 to store the given information in the memory portion 28 and control for causing the modulating/demodulating portion 30 to modulate the inquiry wave Fc received by the antenna portion 18 with the information signal stored in the memory portion 28 and transmitting back the modulated inquiry wave Fc as the response wave Fr through the antenna portion 18.

Figure 3:
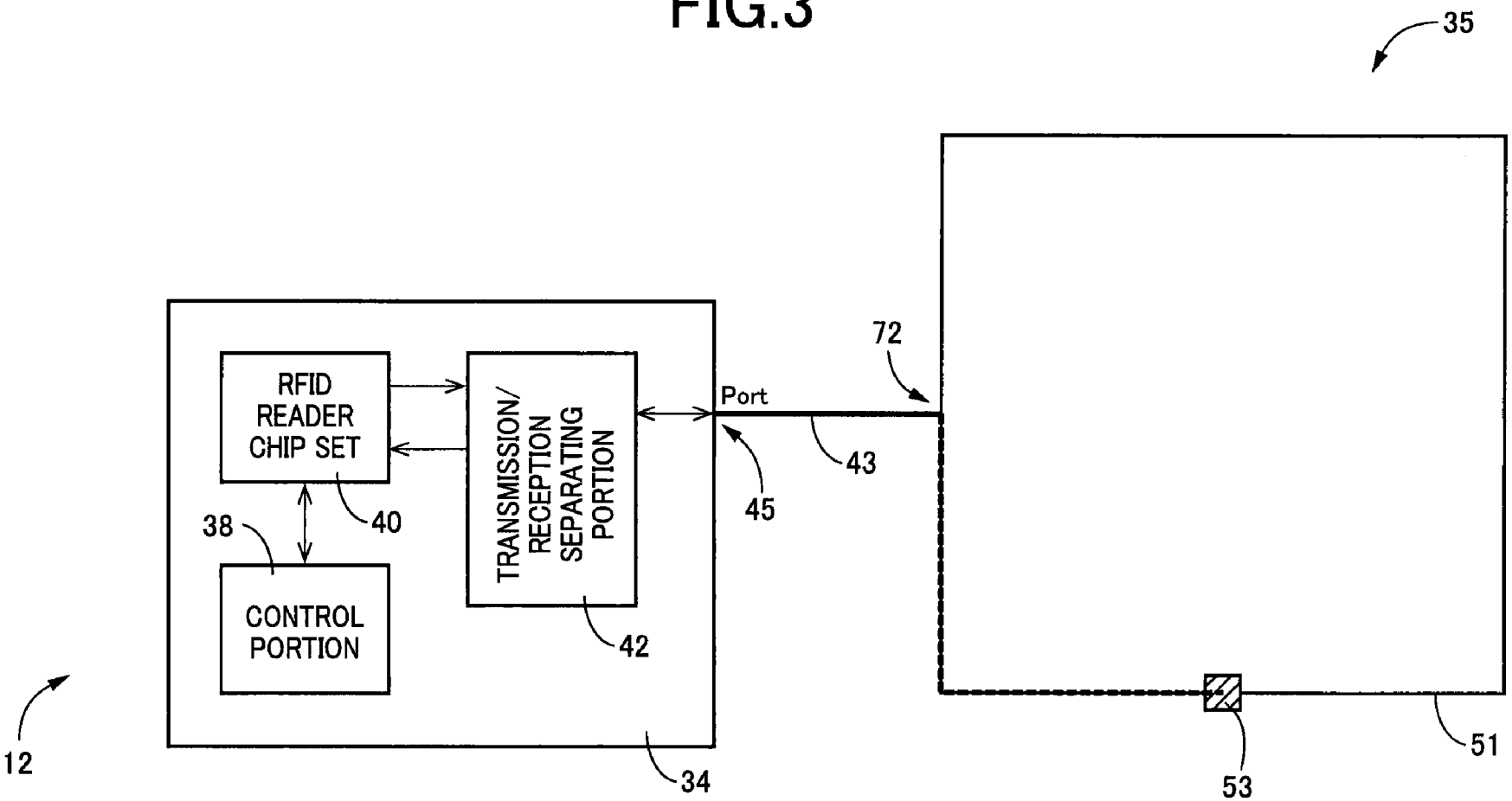
FIG. 3 depicts an example of a configuration of a radio tag communication apparatus to which a one-wavelength loop antenna as one embodiment of the present invention applies.

The radio tag communication apparatus 12 communicates with the radio tag 14 for information exchange to carry out at least information writing or information reading to or from the radio tag 14. As depicted in FIG. 3, the radio tag communication apparatus 12 includes a body 34 that carries out processes of outputting a transmission signal (high-frequency signal) related to the communication, demodulating a reply signal that is transmitted back from the radio tag 14 in response to the transmission signal, etc., and a one-wavelength loop antenna 35 as one embodiment of the present invention that is connected to the body 34 to function as a transmitting/receiving antenna related to the communication.

The body 34 has a control portion 38 that carries out various control, such as control of communication between the radio tag communication apparatus 12 and the radio tag 14, an RFID reader chip set 40 that carries out signal processing, such as outputting the transmission signal in response to a command from the control portion 38 and demodulating a reply signal from the radio tag 14, a transmission/reception separating portion 42 that supplies a transmission signal output from the RFID reader chip set 40 to a port 45 and supplies a reception signal coming in from the port 45 to the RFID reader chip set 40, and the port 45 that is the input/output port corresponding to a feeding cable 43. The transmission/reception separating portion 42 is provided preferably as a widely known directional coupler, circulator, etc.

The control portion 38 is a so-called microcomputer that includes a CPU (Central Processing Unit), a ROM (Read-Only Memory), a RAM (Random Access Memory), etc., and that carries out signal processing in accordance with a program stored in advance in the ROM while using the temporary storage function of the RAM. The control portion 38 transmits a given transmission signal to the radio tag 14 via the RFID reader chip set 40 and demodulates or decodes a reply signal transmitted back from the radio tag 14 in response to the transmission signal in carrying out control over communication between the radio tag communication apparatus 12 and the radio tag 14.

The one-wavelength loop antenna 35 has a rectangular (square) antenna element 51 equipped with a single feeding point 53 and having a length dimension equivalent to one wavelength related to communication, and a feeding cable 43 for feeding current to the feeding point 53 on the antenna element 51. Feeding current to the feeding point 53 causes the antenna element 51 to function as a one-wavelength loop antenna. It is preferable that the feeding cable 43 be a coaxial cable having an inner conductor and an outer conductor that are arranged coaxially.

Figure 4:
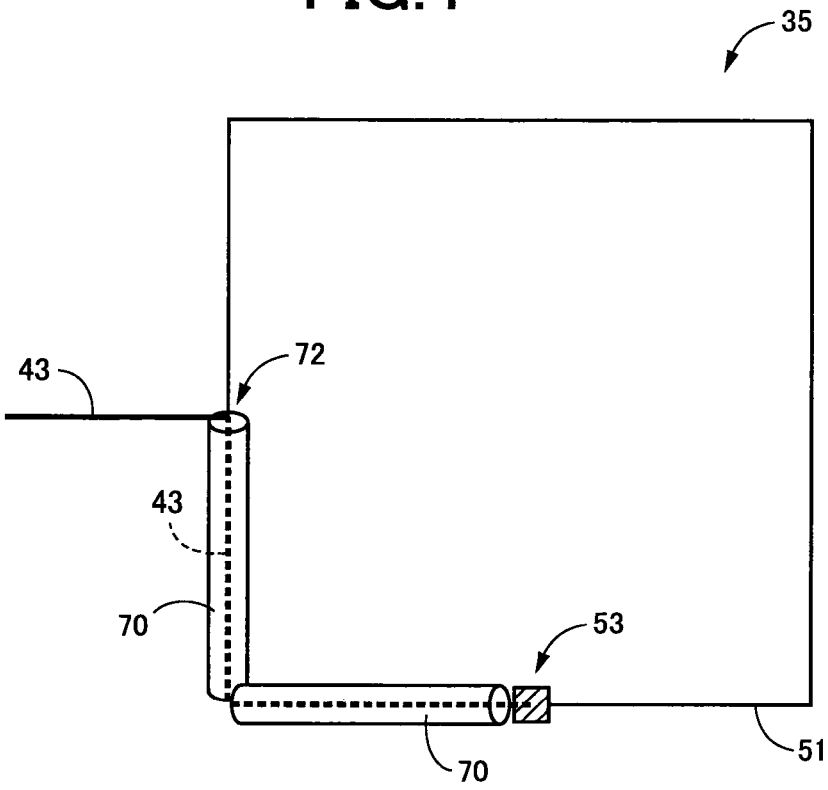
FIG. 4 depicts an example of a configuration of the one-wavelength loop antenna as one embodiment of the present invention that applies to the radio tag communication apparatus of FIG. 3.

As depicted in FIG. 4, a part of the antenna element 51 in the one-wavelength loop antenna 35 of this embodiment includes a pipelike conductor (tubular conductor) 70 having a hollow axis. The feeding cable 43 extends through the hollow of the pipelike conductor 70 in the section between the feeding point 53 and an extraction position 72 located to be distant (along the antenna element 51) from the feeding point 53 by ⅛ wavelength or more to ⅜ wavelength or less.

In the one-wavelength loop antenna, in general, if the feeding cable (coaxial cable) is brought closer to the antenna near a feeding portion, electrical coupling occurs between the exterior of the outer conductor of the feeding cable and the antenna, which may result in a drop in sensitivity. The feeding cable, therefore, should desirably be extracted in perpendicular to the antenna in the one-wavelength loop antenna. Due to configurative restrictions, however, perpendicularly extracting the feeding cable at a feeding position is difficult in some cases. To reduce the influence that the body 34 exerts on the one-wavelength loop antenna 35, the antenna element 51 should desirably operate as an antenna that generates an electric field perpendicular to the body 34. In such a case, however, extracting the feeding cable perpendicularly at the feeding position leads to the extremely limited positional relation between the body 34 and the antenna element 51. To deal with this, according to the one-wavelength loop antenna 35 of this embodiment as depicted in FIG. 4, the feeding cable 43 extends through the hollow of the pipelike conductor 70 to extract the feeding cable 43 from the extraction position 72 as a single spot. This inhibits the occurrence of electrical coupling between the exterior of the outer conductor of the feeding cable 43 and the antenna, thus preferably prevents an influence on communication.

According to this embodiment, a part of the antenna element 51 includes the pipelike conductor 70 having the hollow axis, and the feeding cable 43 extends through the hollow of the pipelike conductor 70 in the section between the feeding point 53 and the extraction position 72 located to be distanced from the feeding point 53 by ⅛ wavelength or more to ⅜ wavelength or less. This allows the extraction position 72 of the feeding cable 43 to be distanced away up to a position at which the amount of current flowing through the antenna is small to preferably avoid a gain decrease due to the influence of the feeding cable 43. The extraction position 72 of the feeding cable 43 is located to be distanced from the feeding point 53 by ⅛ wavelength or more to ⅜ wavelength or less, at which location the amount of current is reduced to approximately 70% of the amount of current at the feeding point 53. This further reduces the influence of the feeding cable 43. Hence the one-wavelength loop antenna 35 that inhibits the influence of the feeding cable 43 on communication is provided.

Another preferred embodiment of the present invention will then be described in detail with the drawings. In the following description, the common component in embodiments will be denoted by the same reference numeral and be omitted in further description.

Figure 5:
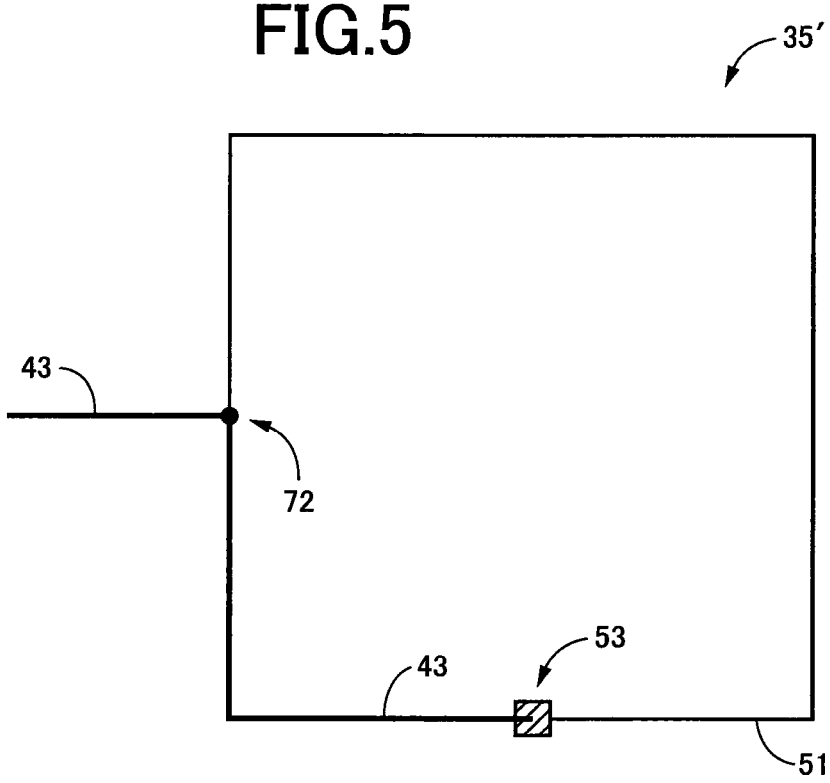
FIG. 5 depicts an example of a configuration of a one-wavelength loop antenna as another embodiment of the present invention that applies to the radio tag communication apparatus of FIG. 3.

As depicted in FIG. 5, in a one-wavelength loop antenna 35' of this embodiment, the section between the feeding point 53 and the extraction position 72 of the feeding cable 43 located to be distanced from the feeding point 53 by ⅛ wavelength or more to ⅜ wavelength or less includes the outer conductor of the feeding cable 43, and the coaxial cable making up the feeding cable 43 has its outer conductor connected electrically to the antenna element 51 at the extraction position 72. In other words, the outer conductor of the feeding cable 43 serves as a part of the antenna element 51 and is connected to the antenna element 51 at the extraction position 72 to configure the one-wavelength loop antenna 35' of this embodiment.

According to this embodiment, the feeding cable 43 includes the coaxial cable having the inner conductor and the outer conductor that are arranged coaxially, the one-wavelength loop antenna 35' has the section including the outer conductor of the feeding cable 43 that is between the feeding point 53 and the extraction position 72 of the feeding cable 43 located to be distanced from the feeding point 53 by ⅛ wavelength or more to ⅜ wavelength or less, and the coaxial cable making up the feeding cable 43 has its outer conductor connected electrically to the antenna element 51 at the extraction position 72. This allows the extraction position 72 of the feeding cable 43 to be distanced away up to a position at which the amount of current flowing through the antenna is small to preferably avoid a gain decrease due to the influence of the feeding cable 43. The extraction position 72 of the feeding cable 43 is located to be distanced from the feeding point 53 by ⅛ wavelength or more to ⅜ wavelength or less, at which location the amount of current is reduced to approximately 70% of the amount of current at the feeding point 53. This further reduces the influence of the feeding cable 43. Hence the one-wavelength loop antenna 35 that inhibits the influence of the feeding cable 43 on communication is provided.

Figure 6:
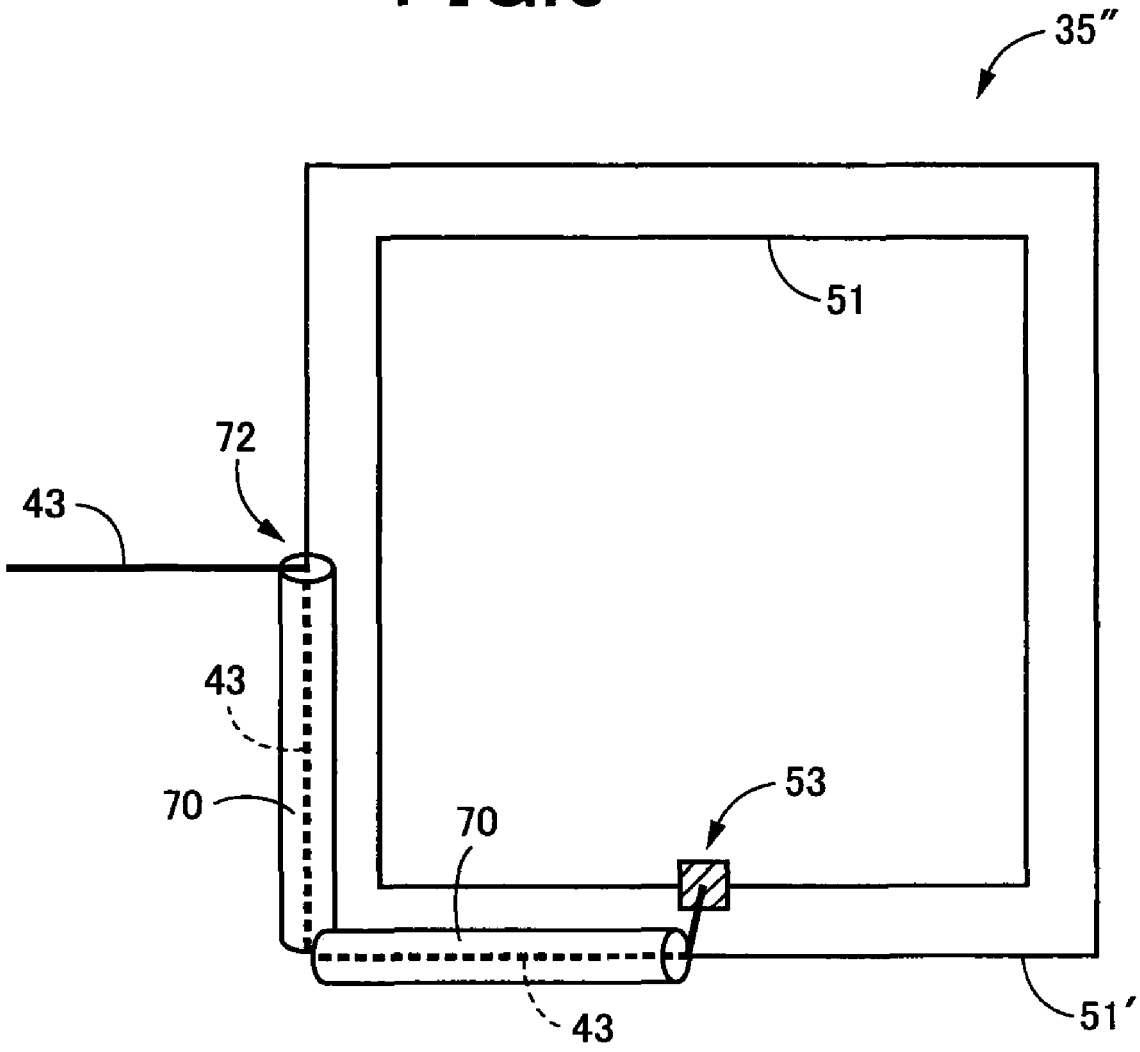
FIG. 6 depicts an example of a configuration of a one-wavelength loop antenna as still another embodiment of the present invention that applies to the radio tag communication apparatus of FIG. 3.

As depicted in FIG. 6, a one-wavelength loop antenna 35" of this embodiment has the looped antenna element 51 having the length equivalent to one wavelength related to communication, the feeding cable 43 connected to the feeding point 53 on the antenna element 51, and a looped reflector 51' disposed at a prescribed position relative to the antenna element 51 and slightly longer in overall length than the antenna element 51.

The reflector 51', for example, includes a rectangularly shaped conductor cable that is disposed near the antenna element 51 serving as a radiator so that the conductor cable is separated from the conductor making up the antenna element 51 across a virtually prescribed interval. A part of the reflector 51' includes the pipelike conductor (tubular conductor) 70 having the hollow axis. The feeding cable 43 is extracted from the extraction position 72 located to be distanced from the feeding point 53 by ⅛ wavelength or more to ⅜ wavelength or less, and extends through the hollow of the pipelike conductor 70 in the section between the feeding point 53 and the extraction position 72.

According to this embodiment, a part of the reflector 51' includes the pipelike conductor 70 having the hollow axis, and the feeding cable 43 extends through the hollow of the pipelike conductor 70 in the section between the feeding point 53 and the extraction position 72 located to be distanced from the feeding point 53 by ⅛ wavelength or more to ⅜ wavelength or less. This allows the extraction position 72 of the feeding cable 43 to be distanced away up to a position at which the amount of current flowing through the antenna is small to preferably avoid a gain decrease due to the influence of the feeding cable 43 in a one-wavelength loop antenna 36" having the looped reflector 51'. The extraction position 72 of the feeding cable 43 is located to be distanced from the feeding point 53 by ⅛ wavelength or more to ⅜ wavelength or less, at which location the amount of current is lower than the amount of current at the feeding point 53. This further reduces the influence of the feeding cable 43. Hence the one-wavelength loop antenna 35 that inhibits the influence of the feeding cable 43 on communication is provided.

Figure 7:
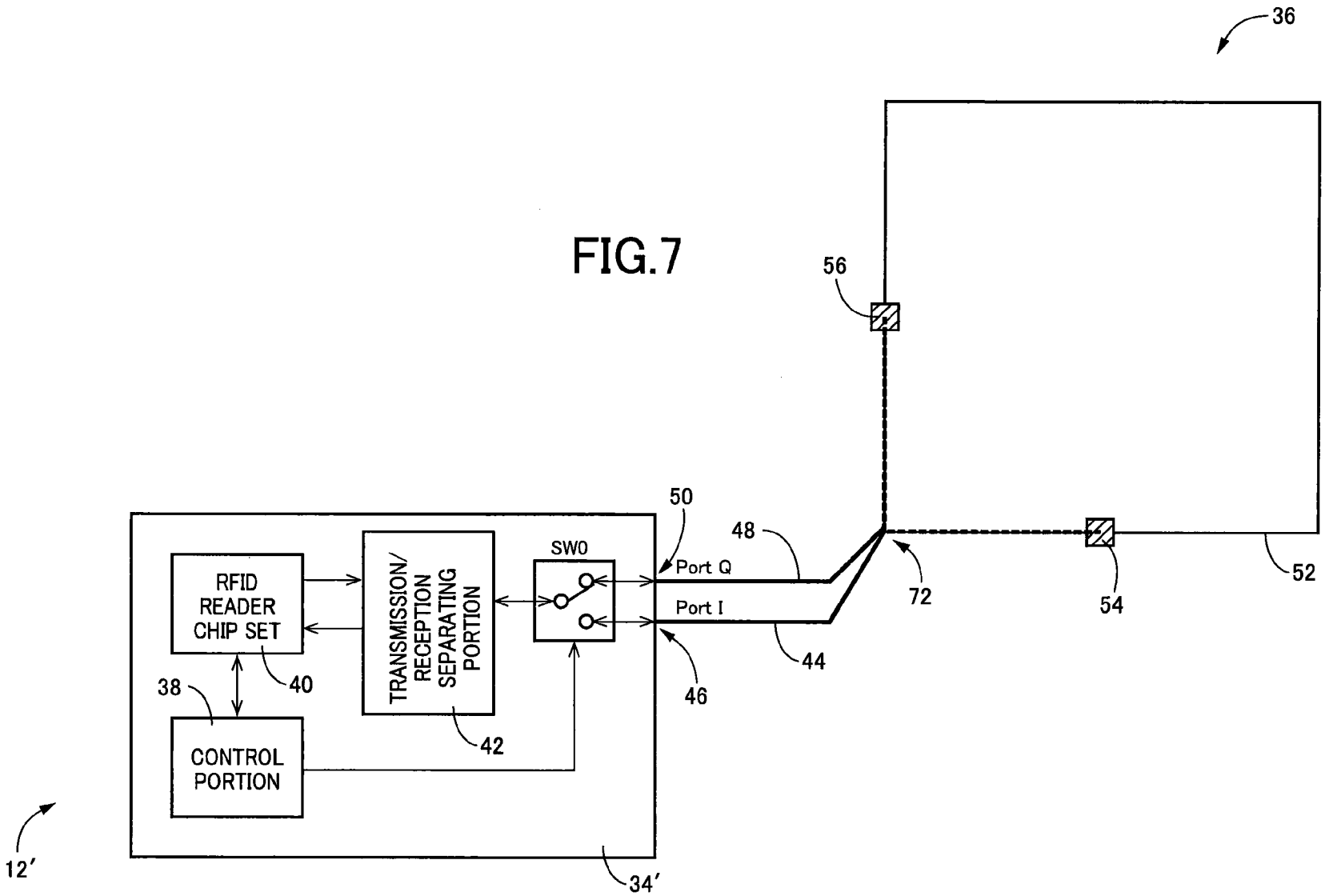
FIG. 7 depicts an example of a configuration of a radio tag communication apparatus to which the one-wavelength loop antenna as another embodiment of the present invention applies.

As depicted in FIG. 7, a radio tag communication apparatus 12' of this embodiment further includes a first port (port I) 46 serving as an input/output port corresponding to a first feeding cable 44, a second port (port Q) 50 serving as an input port corresponding to a second feeding cable 48, and a 0th switch SW0 that switches connection between the transmission/reception separating portion 42 and the first port 46 and the second port 50. The transmission/reception separating portion 42 is provided preferably as a well known directional coupler, circulator, etc. The control portion 38 incorporated in the radio tag communication apparatus 12' of this embodiment carries out various control over communication between the radio tag communication apparatus 12' and the radio tag 14, as described above, and outputs a dc signal for switching by the 0th switch SW0.

The one-wavelength loop antenna 36 has a rectangular (square) antenna element 52 that is of a looped shape having a first feeding point 54 corresponding to a first polarization plane (horizontal polarization plane) and a second feeding point 56 corresponding to a second polarization plane (vertical polarization plane), both feeding points being shifted to each other by ¼ wavelength (¼ of a wavelength related to communication), and that has a length dimension equivalent to one wavelength related to communication, the first feeding cable 44 for feeding current to the first feeding point 54 of the antenna element 52, and the second feeding cable 48 for feeding current to the second feeding point 56 of the antenna element 52. One of the first feeding cable 44 and the second feeding cable 48 is fed with current based on switching by the 0th switch SW0 to causes the antenna element 52 to function as a one-wavelength loop antenna. The one-wavelength loop antenna 36 of this embodiment is, therefore, a polarization plane switching antenna unit (polarization plane diversity antenna) caused to function selectively as a horizontal polarization antenna or a vertical polarization antenna.

It is preferable that each of the first feeding cable 44 and the second feeding cable 48 be a coaxial cable having an inner conductor and an outer conductor that are arranged coaxially. The first feeding cable 44 connects the first port 46 of the body 34' to the first feeding point 54 of the antenna element 52, serving as a horizontal polarization cable (cable I) for allowing the one-wavelength loop antenna 36 to function as a horizontal polarization antenna. The second feeding cable 48 connects the second port 50 of the body 34' to the second feeding point 56 of the antenna element 52, serving as a vertical polarization cable (cable Q) for allowing the loop antenna unit 36 to function as a vertical polarization antenna.

Figure 8:
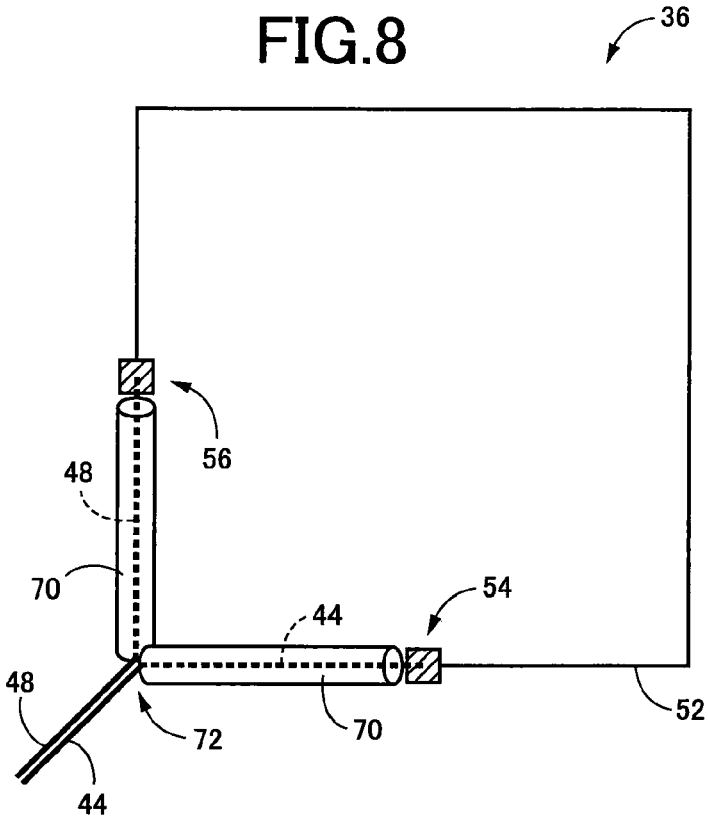
FIG. 8 depicts an example of a configuration of the one-wavelength loop antenna as one embodiment of the present invention that applies to the radio tag communication apparatus of FIG. 7.

As depicted in FIG. 8, a part of the antenna element 52 in the one-wavelength loop antenna 36 of this embodiment includes the pipelike conductor (tubular conductor) 70 having the hollow axis. The feeding cable 44 and the feeding cable 48 are put through the hollow of the pipelike conductor 70 in the sections between the feeding points 54 and 56 and the extraction position 72 distanced from the feeding point 54 and from the feeding pint 56 by ⅛ wavelength or more, respectively. It is preferable, as depicted in FIG. 8, that the feeding cables 44 and 48 be extracted from the common extraction position 72, which is virtually in the middle between the first feeding point 54 and the second feeding point 56 on the antenna element 52. In other words, the overall length of the pipelike conductor 70 provided in correspondence to the locations of the feeding points 54 and 56 is about ¼ of the wavelength used for communication. Each of the feeding points 54 and 56 has a hole at its center from which each of the feeding cables 44 and 48 is lead out through the pipelike conductor 70.

In the case of the polarization plane switching loop antenna having two feeding points, both feeding cables cannot be set vertically when one of the feeding cables corresponding to one of two feeding points is to be extracted from the same single spot. To deal with this, in the one-wavelength loop antenna 36 of this embodiment of FIG. 8, two feeding cables 44 and 48 are each put through the hollow of the pipelike conductor 70 to extract the feeding cables 44 and 48 all together from the extraction position 72 as a single spot. This inhibits the occurrence of electrical coupling between the exterior of the outer conductors of the feeding cables 44 and 48 and the antenna, thus preferably prevents an influence on communication that is exerted by unused one of the feeding cables 44 and 48.

According to this embodiment, a part of the antenna element 52 includes the pipelike conductor 70 having the hollow axis, and the feeding cable 44 and the feeding cable 48 are put through the hollow of the pipelike conductor 70 in the sections between the feeding points 54 and 56 and the extraction position 72 distanced from the feeding point 54 and from the feeding point 56 by about ⅛ wavelength, respectively. The extraction position 72 of the feeding cables 44, 48 is located to be distanced from each of the feeding points 54, 56 by about ⅛ wavelength, at which location the amount of current is reduced to approximately 70% of the amount of current at the feeding points 54, 56. This further reduces the influence of the feeding cables 44, 48. Hence the one-wavelength loop antenna 36 that inhibits the influence of the feeding cables 44, 48 on communication is provided.

The feeding points 54 and 56 are located to be distanced from each other by about ¼ wavelength, thus arranged to have less influence on each other. Specifically, the feeding point 56 is located at the position at which a current flow becomes the minimum when current is fed to the feeding point 54, while the feeding point 54 is located at the position at which a current flow becomes the minimum when current is fed to the feeding point 56.

The one-wavelength loop antenna 36 has the first feeding cable 44 for feeding current to the first feeding point 54 of the antenna element 52 and the second feeding cable 48 for feeding current to the second feeding point 56, and the first and second feeding cables 44 and 48 are extracted from the common extraction position 72. This enables the double-feeding one-wavelength loop antenna 36 in which unfeeding one of the feeding cables 44 and 48 is apt to exert an influence on communication to preferably inhibit the influence of the feeding cables 44 and 48 on communication.

The extraction position 72 is in the middle between the first feeding point 54 and the second feeding point 56 on the antenna element 52. This enables providing the double-feeding one-wavelength loop antenna 36 of a practical form that preferably inhibits the influence of the feeding cables 44 and 48 on communication.

Figure 9:
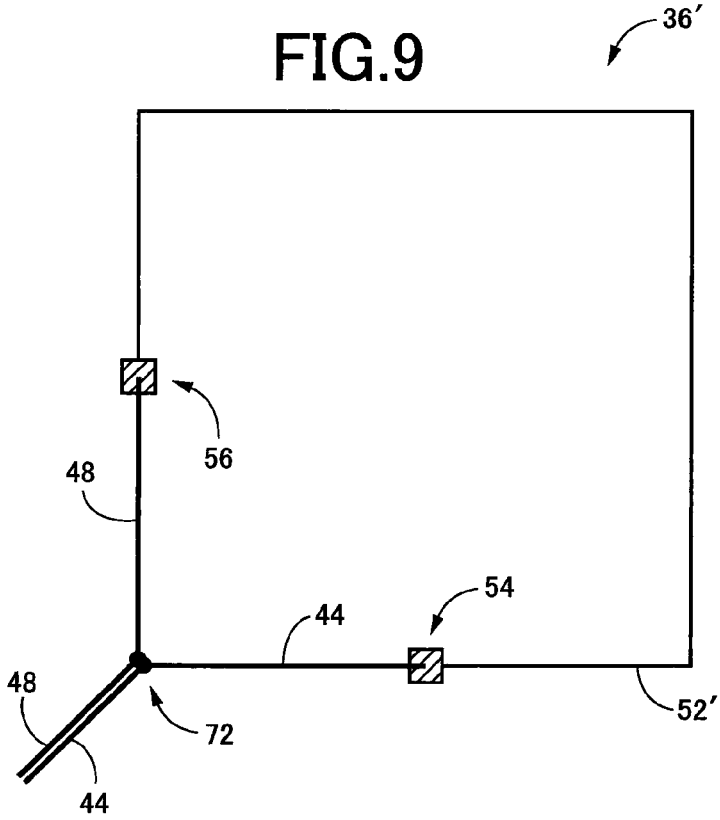
FIG. 9 depicts an example of a configuration of the one-wavelength loop antenna as another embodiment of the present invention that applies to the radio tag communication apparatus of FIG. 7.

As depicted in FIG. 9, in an antenna element 52' of a one-wavelength loop antenna 36' of this embodiment, the sections between the first feeding point 54 and the second feeding point 56 and the extraction position 72 common to the first and second feeding cables 44 and 48 and located to be distanced from the first feeding point 54 and from the second feeding point 56 by about ⅛ wavelength, respectively, include the outer conductors of the first feeding cable 44 and the second feeding cable 48, and the coaxial cables making up the first and second feeding cables 44 and 48 have their outer conductors electrically connected to each other at the extraction position 72. In other words, the outer conductors of the feeding cables 44 and 48 serve as a part of the antenna element 52', and those outer conductors of the coaxial cables are connected to each other to configure the double-feeding one-wavelength loop antenna 36'.

According to this embodiment, each of the first and second feeding cables 44 and 48 includes the coaxial cable having the inner conductor and the outer conductor that are arranged coaxially, the antenna element 52' has the sections including the outer conductors of the first and second feeding cables 44 and 48 that are between the first feeding point 54 and the second feeding point 56 and the extraction position 72 common to the first and second feeding cables 44 and 48 and located to be distanced from the first feeding point 54 and from the second feeding point 56 by about ⅛ wavelength, respectively, and the coaxial cables making up the first and second feeding cables 44 and 48 have their outer conductors electrically connected to each other at the extraction position 72. This allows the extraction position 72 of the feeding cables 44 and 48 to be distanced away up to a position at which the amount of current flowing through the antenna is small to preferably avoid a gain decrease due to the influence of the feeding cables 44 and 48 in the double-feeding one-wavelength loop antenna 36" in which unfeeding one of the feeding cables 44 and 48 is apt to exert an influence on communication. The extraction position 72 of the feeding cables 44 and 48 is located to be distanced respectively from the feeding points 54 and 56 by about ⅛ wavelength, at which location the amount of current is reduced to approximately 70% of the amount of current at the feeding points 54 and 56. This further reduces the influence of the feeding cables 44 and 48. Hence the one-wavelength loop antenna 36' that inhibits the influence of the feeding cables 44 and 48 on communication is provided.

Figure 10:
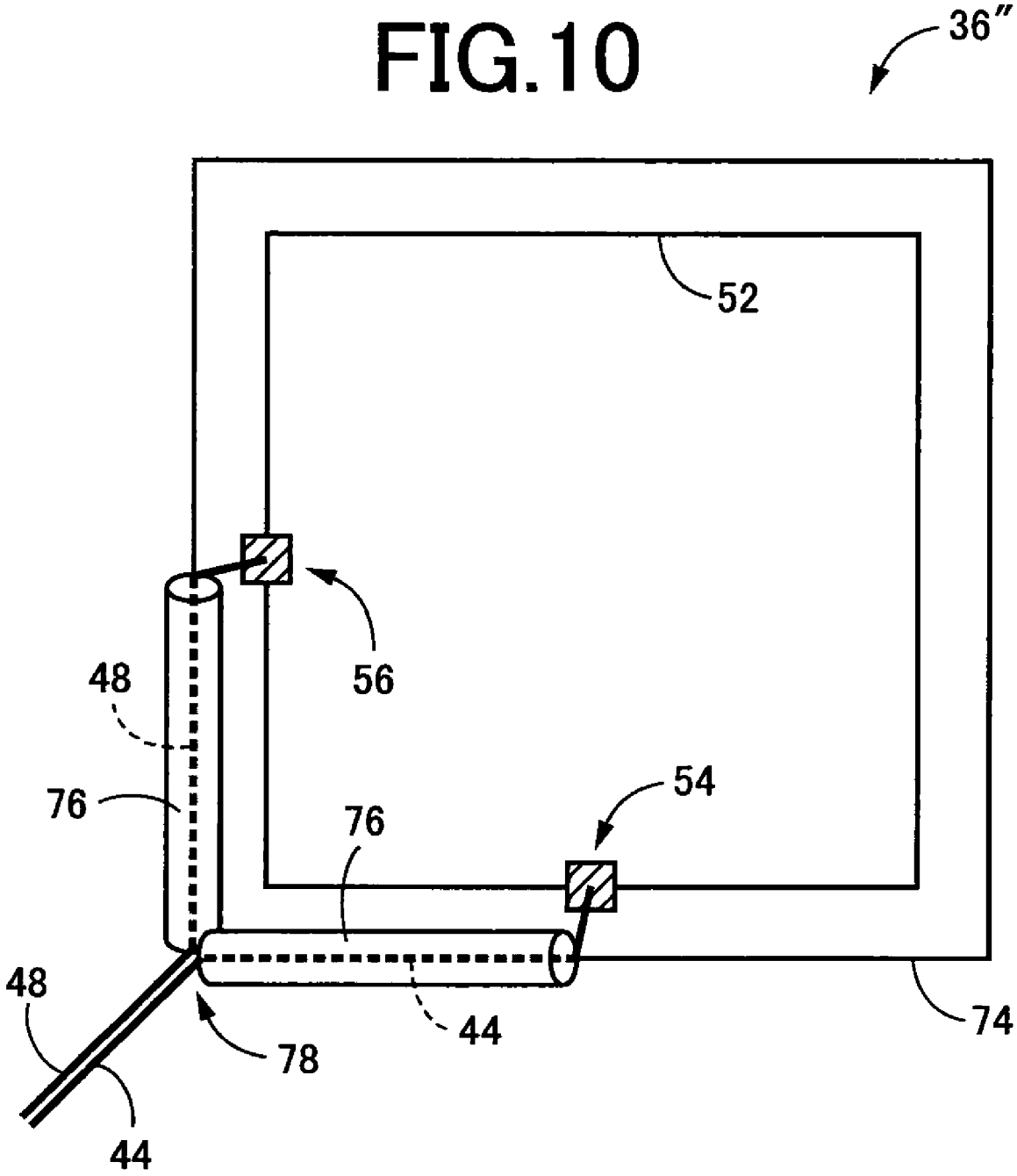
FIG. 10 depicts an example of a configuration of the one-wavelength loop antenna as still another embodiment of the present invention that applies to the radio tag communication apparatus of FIG. 7.

As depicted in FIG. 10, a one-wavelength loop antenna 36" of this embodiment has the looped antenna element 52 having the length equivalent to one wavelength related to communication, the first feeding cable 44 for feeding current to the first feeding point 54 of the antenna element 52, the second feeding cable 48 for feeding current to the second feeding point 56 of the antenna element 52, and a looped reflector 74 disposed at a prescribed position relative to the antenna element 52 and slightly longer in overall length than the antenna element 52.

The reflector 74, for example, includes a rectangularly shaped conductor cable that is disposed near the antenna element 52 serving as a radiator so that the conductor cable is separated from the conductor making up the antenna element 52 across a virtually prescribed interval. A part of the reflector 74 includes a pipelike conductor (tubular conductor) 76 having a hollow axis. The first feeding cable 44 and the second feeding cable 48 are extracted from a common extraction position 78 located to be distanced from the feeding point 54 and from the feeding point 56 by about ⅛ wavelength, respectively. The first feeding cable 44 and the second feeding cable 48 are put through the hollow of the pipelike conductor 76 in the sections between the feeding point 54 and the feeding point 56 and the extraction position 78, respectively.

According to this embodiment, a part of the reflector 74 includes the pipelike conductor 76 having the hollow axis, and the first feeding cable 44 and the second feeding cable 48 are put through the hollow of the pipelike conductor 76 in the sections between the feeding point 54 and the feeding point 56 and the extraction position 78 located to be distanced from the feeding point 54 and from the feeding point 56 by about ⅛ wavelength, respectively. This allows the extraction position 78 of the feeding cables 44, 48 to be distanced away up to a position at which the amount of current flowing through the antenna is small to preferably avoid a gain decrease due to the influence of the feeding cables 44, 48 in a one-wavelength loop antenna 36" having the looped reflector 74. The extraction position 78 of the feeding cables 44, 48 is located to be distanced from the feeding points 54, 56 by about ⅛ wavelength, at which location the amount of current is reduced compared to the amount of current at the feeding points 54, 56. This further reduces the influence of the feeding cables 44, 48. Hence the one-wavelength loop antenna 36" that inhibits the influence of the feeding cables 44, 48 on communication is provided.

The one-wavelength loop antenna 36" has the first feeding cable 44 for feeding current to the first feeding point 54 of the antenna element 52 and the second feeding cable 48 for feeding current to the second feeding point 56, and the first and second feeding cables 44 and 48 are extracted from the common extraction position 78. This enables the double-feeding one-wavelength loop antenna 36" in which unfeeding one of the feeding cables 44 and 48 is apt to exert an influence on communication to preferably inhibit the influence of the feeding cables 44 and 48 on communication.

While preferred embodiments of the present invention have been described in detail with reference to the drawings, the present invention is not limited by this description but may be carried out in another mode.

For example, a case of providing the one-wavelength loop antenna 36, etc., of the present invention as a transmitting/receiving antenna in the radio tag communication apparatus 12 that communicates with the radio tag 14 for information exchange is described in the embodiments. The present invention is not limited to this case. For example, the present invention may be applied only to the transmitting antenna or to the receiving antenna of the radio tag communication apparatus 12. The one-wavelength loop antenna of the present invention is preferably applied also to a communication apparatus other than the RFID system.

While the one-wavelength loop antenna 36, etc., has the antenna element 52, etc., of a rectangular (square) shape in the embodiments, the loop antenna 36, etc., may have the antenna element of, for example, a circular or elliptical shape. The form of the loop antenna, therefore, is properly selected from various forms in accordance with the design of the loop antenna.

While in the embodiments the present invention is applied to the double-feeding one-wavelength loop antenna 36, etc., the present invention may be applied properly to a one-wavelength loop antenna having three or more feeding points.

Although no specific examples are presented, the present invention may variously be modified or altered without departing from the spirit of the invention.

What is claimed is:

1. A one-wavelength loop antenna comprising:

a looped antenna element having a length equivalent to one wavelength related to communication; and a feeding cable for feeding current to a feeding point on the antenna element, wherein an inner conductor is disposed inside an outer conductor in a section between the feeding point and an extraction position of the feeding cable distanced from the feeding point by ⅛ wavelength or more, at least one of the outer and inner conductors functioning as the feeding cable.

2. The one-wavelength loop antenna of claim 1, wherein at least a part of the antenna element includes a pipelike conductor having a hollow axis, and wherein the feeding cable extends through the hollow of the pipelike conductor in a section between the feeding point and an extraction position distanced from the feeding point by ⅛ wavelength or more.

3. The one-wavelength loop antenna of claim 1, wherein the feeding cable includes a coaxial cable having an inner conductor and an outer conductor that are arranged coaxially, and wherein the antenna element includes a section including the outer conductor of the feeding cable that is between the feeding point and an extraction position distanced from the feeding point by ⅛ wavelength or more.

4. The one-wavelength loop antenna of claim 1, further comprising a looped reflector disposed at a prescribed position relative to the antenna element, wherein at least a part of the reflector includes a pipelike conductor having a hollow axis, and wherein the feeding cable extends through the hollow of the pipelike conductor in a section between the feeding point and an extraction position distanced from the feeding point by ⅛ wavelength or more.

5. The one-wavelength loop antenna of claim 1, comprising:

a first feeding cable for feeding current to a first feeding point on the antenna element; and a second feeding cable for feeding current to a second feeding point, the first and second feeding cables being extracted from the common extraction position.

6. The one-wavelength loop antenna of claim 3, comprising:

a first feeding cable for feeding current to a first feeding point on the antenna element; and a second feeding cable for feeding current to a second feeding point, the first and second feeding cables having their outer conductors electrically connected to each other at the common extraction position.

7. The one-wavelength loop antenna of claim 5, wherein the first feeding point and the second feeding point are located to be distanced from each other by ¼ wavelength.

8. The one-wavelength loop antenna of claim 5, wherein the extraction position is in the middle between the first feeding point and the second feeding point on the antenna element.

* * * * *